US012478173B2

(12) United States Patent
Choi

(10) Patent No.: US 12,478,173 B2
(45) Date of Patent: Nov. 25, 2025

(54) BELT HOLDER FOR TAPE MEASURE

(71) Applicant: Won Woo Choi, Busan (KR)

(72) Inventor: Won Woo Choi, Busan (KR)

( * ) Notice: Subject to any disclaimer, the term of this patent is extended or adjusted under 35 U.S.C. 154(b) by 131 days.

(21) Appl. No.: 18/635,053

(22) Filed: Apr. 15, 2024

(65) Prior Publication Data

US 2025/0318631 A1 Oct. 16, 2025

(51) Int. Cl.
*A45F 5/02* (2006.01)
*A45F 5/00* (2006.01)

(52) U.S. Cl.
CPC ..... *A45F 5/021* (2013.01); *A45F 5/1575* (2025.01)

(58) Field of Classification Search
CPC .. A45F 5/021; A45F 5/1575; A45F 2005/026; G01B 2003/1074; G01B 3/1071; Y10S 224/904
See application file for complete search history.

(56) References Cited

U.S. PATENT DOCUMENTS

| | | | | |
|---|---|---|---|---|
| 10,182,641 | B1 * | 1/2019 | Goodman | G01B 3/1071 |
| 10,470,556 | B1 | 11/2019 | Choi | |
| 11,517,103 | B2 * | 12/2022 | Choi | G01B 3/1041 |
| 2001/0054217 | A1 * | 12/2001 | Wang | A45F 5/021 24/3.1 |
| 2012/0260513 | A1 | 10/2012 | Daugherty et al. | |

FOREIGN PATENT DOCUMENTS

| | | | |
|---|---|---|---|
| JP | 2006-250887 | A | 9/2006 |
| JP | 2008-255566 | A | 10/2008 |

* cited by examiner

*Primary Examiner* — Adam J Waggenspack
(74) *Attorney, Agent, or Firm* — Paratus Law Group, PLLC

(57) ABSTRACT

Proposed is a belt holder for a tape measure including a holder body, a clip holding part, a locking bracket, a bracket spring, a push button with a one-way rotation inducing groove, a push button spring, a push button spring, and a position maintenance pin, wherein due to an operation of the push button and the elastic force of the push button spring, a locking jaw of the locking bracket can be easily switched between locked and unlocked states as the push button is pushed in and out.

3 Claims, 23 Drawing Sheets

BELT HOLDER FOR TAPE MEASURE

BACKGROUND

The present disclosure relates to a belt holder for a tape measure and, more particularly, to a belt holder for a tape measure to hang a tape measure while attached to a waist belt.

Tape measures are tools widely used in construction sites since they allow a user to easily measure length and are easy to carry.

Because a tape measure is frequently used in construction, it is usually carried by hanging it onto a belt. To make it easy to carry a tape measure like this, the tape measure is equipped with a belt clip.

A typical belt holder for a tape measure is a combination of a holder body and a holding part with a clip through hole formed in the vertical direction through which a belt clip of a tape measure passes in order to hang the tape measure. With a typical belt holder for a tape measure like this, a worker may use both hands freely by placing a tape measure's belt clip on a holding part and securing a tape measure, and conveniently use the tape measure by detaching it from the holding part whenever necessary.

However, when a tape measure is mounted using a typical belt holder for a tape measure in this way, the tape measure is easily separated from the belt holder when a worker moves his or her body vigorously, which is problematic.

Accordingly, there is a need for a belt holder for a tape measure that secures a tape measure to the belt holder in a locked state after attaching the tape measure to the belt holder so that the tape measure is not separated, and allows the tape measure to be unlocked and separated from the belt holder only when necessary.

Meanwhile, as an example of related art, U.S. Pat. No. 11,517,103 has been presented, and the above related art is considered to be integrated into this specification.

SUMMARY

Accordingly, the present disclosure has been made keeping in mind the above problems occurring in the related art, and the present disclosure is intended to provide a belt holder for a tape measure with a new structure in which a locking jaw of a locking bracket can be easily switched between locked and unlocked states by operating a push button.

In order to achieve the above objective, according to an aspect of the present disclosure, there is provided a belt holder for a tape measure, the belt holder including: a holder body, with a clip holding part being attached to a front thereof so that a clip through hole is formed between the holder body and the clip holding part in a vertical direction through which a belt clip of the tape measure passes; a locking bracket including: a locking jaw provided on a lower side thereof to prevent the belt clip of the tape measure from escaping from the clip through hole; a rotation shaft provided on an upper side thereof to be rotatably coupled to the holder body; and a rotational force input portion provided on an inside thereof, wherein when a rotational force is input to the rotational force input portion, the locking jaw may be rotated around the rotation shaft to move from a position that does not prevent the belt clip from coming off to a position that prevents the belt clip from coming off; a bracket spring provided in the holder body to elastically support the locking bracket in one direction so that the locking jaw of the locking bracket is located at a position that does not prevent the belt clip from coming off; a push button having a push input portion at a top thereof and a one-way rotation inducing groove in the form of a closed curve provided at a center thereof in the vertical direction, and guided by the holder body to reciprocate in the vertical direction so as to apply a rotational force to the rotational force input portion of the locking bracket by moving downward and so as to not apply a rotational force to the rotational force input portion of the locking bracket by moving upward; a push button spring provided in the holder body to elastically support the push button in an upward direction; and a position maintenance pin including: an up/down extension portion extending in the vertical direction; a first coupling end bent in a horizontal direction at a bottom of the up/down extension portion and inserted into and coupled to a pin coupling hole of the holder body; and a second coupling end bent in the horizontal direction at a top of the up/down extension portion and inserted into the one-way rotation inducing groove of the push button, wherein the one-way rotation inducing groove may include: a first seating portion capable of seating the second coupling end; and a second seating portion provided at a higher position than the first seating portion and capable of seating the second coupling end, and according to up and down movements of the push button, the second coupling end of the position maintenance pin may be seated on the first seating portion or the second seating portion while rotating in one direction along the one-way rotation inducing groove.

The one-way rotation inducing groove may further include: a first movement restriction portion provided on a first side in a width direction at a position higher than the second seating portion to limit an upper movement range of the second coupling end; and a second movement restriction portion provided on a second side in the width direction at a position higher than the second seating portion to limit the upper movement range of the second coupling end, wherein due to a downward movement of the push button, the second coupling end located at the first seating portion may move to the first movement restriction portion, due to an upward movement of the push button, the second coupling end located at the first movement restriction portion may move to the second seating portion, due to the downward movement of the push button, the second coupling end located at the second seating portion may move to the second movement restriction portion, due to the upward movement of the push button, the second coupling end located at the second movement restriction portion may move to the first seating portion, so that the second coupling end may rotate in one direction along the one-way rotation inducing groove.

The one-way rotation inducing groove may be formed between an inner guide wall extending in the form of a closed curve and an outer guide wall that extends in the form of a closed curve and is arranged to surround the inner guide wall, wherein the inner guide wall may include: a first inner guide surface that guides the second coupling end in a first width direction when the second coupling end located in the first seating portion moves to the first movement restriction portion; and a second inner guide surface that guides the second coupling end in a second width direction when second coupling end located in the first movement restriction portion moves to the second seating portion, and has the second seating portion connected to a lower part thereof, and the outer guide wall may include: a first outer guide surface that guides the second coupling end in the second width direction when the second coupling end past the first inner guide surface moves to the first movement restriction portion; a second outer guide surface that guides the second coupling end in the second width direction when the second coupling end when the second coupling end located in the second seating portion moves to the second movement restriction portion, and has the second movement restriction portion connected to an upper part thereof; and a third outer guide surface that guides the second coupling end in the first width direction when the second coupling end located in the second movement restriction portion moves to the first seating portion, and has the first seating portion connected to a lower part thereof.

According to the present disclosure, a locking jaw of a locking bracket can be easily switched between locked and unlocked states by operating a push button.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
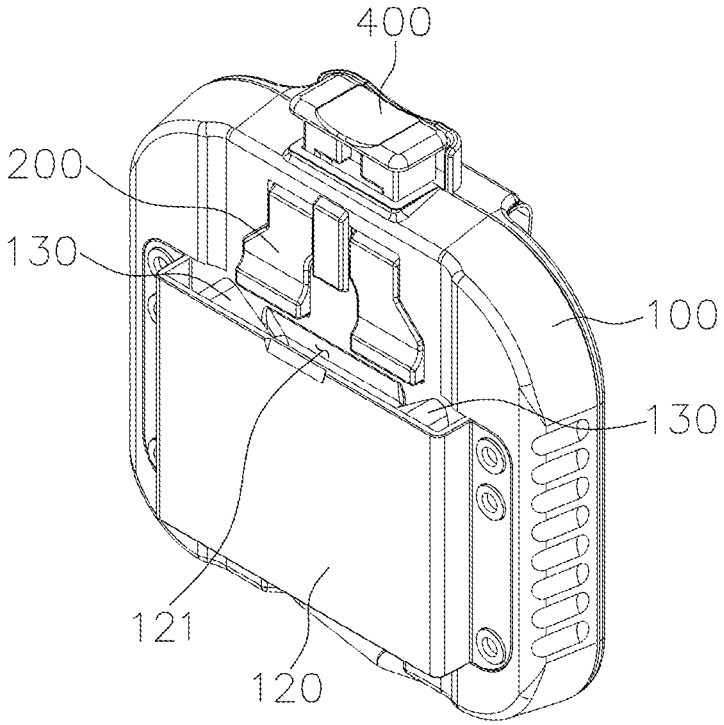
FIG. 1 is a perspective view of a belt holder for a tape measure according to an embodiment of the present disclosure in an unlocked state, viewed from the front.

Hereinafter, with reference to the attached drawings, embodiments of the present disclosure will be described in detail so that those skilled in the art can easily practice it. However, the present disclosure may be implemented in many different forms and is not limited to the embodiments described herein. In addition, in order to clearly explain the present disclosure, parts unrelated to the description are omitted in the drawings, and similar parts are given similar numerals throughout the specification.

Throughout the specification, when a part is said to "include" a certain component, this does not mean excluding other components, but rather including the other components, unless specifically stated to the contrary.

A belt holder for a tape measure according to an embodiment of the present disclosure is intended to be able to hold a conventional tape measure equipped with a belt clip.

The belt holder for a tape measure of the present disclosure includes a holder body 100, a locking bracket 200, a bracket spring 300, a push button 400, a push button spring 500, and a position maintenance pin 600.

Figure 2:
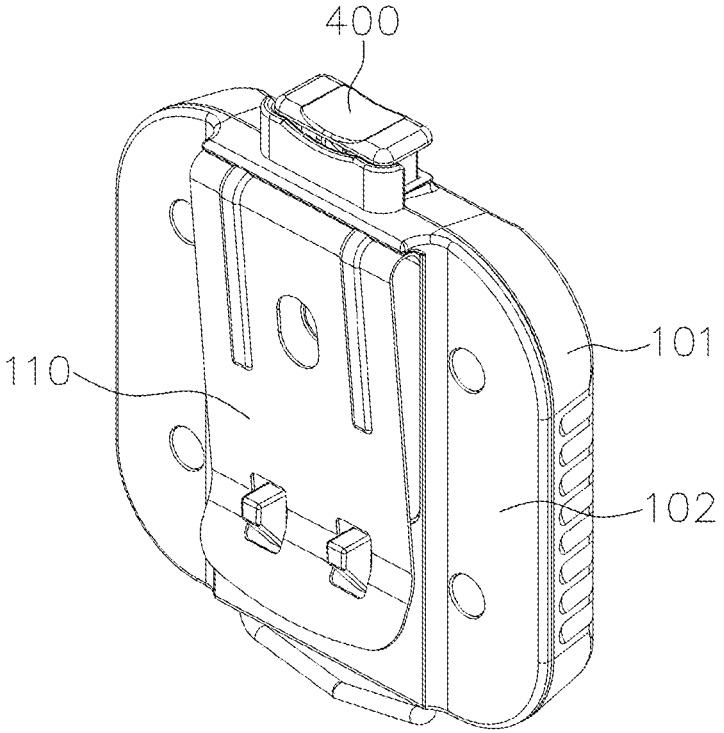
FIG. 2 is a perspective view of FIG. 1 viewed from the rear.
Figure 3:
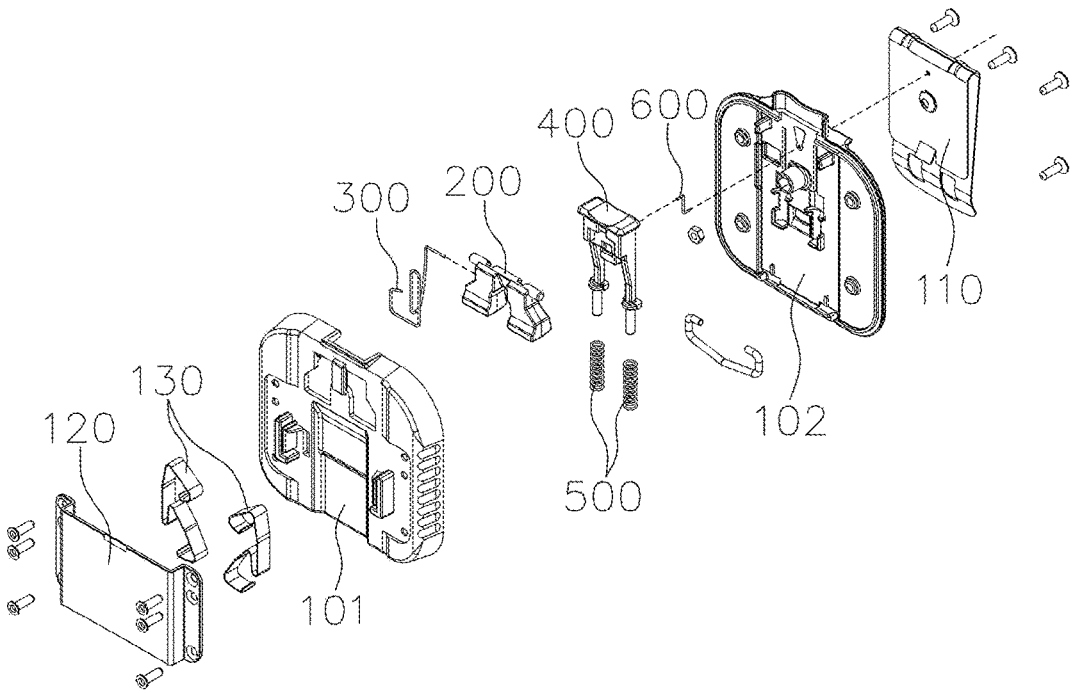
FIG. 3 is an exploded perspective view showing the parts in FIG. 1 separated.

A belt coupling portion 110 for mounting on a belt is provided on the rear of the holder body 100 (see FIGS. 2 and 3). The belt coupling portion 110 may be changed and used in many different forms.

Figure 16:
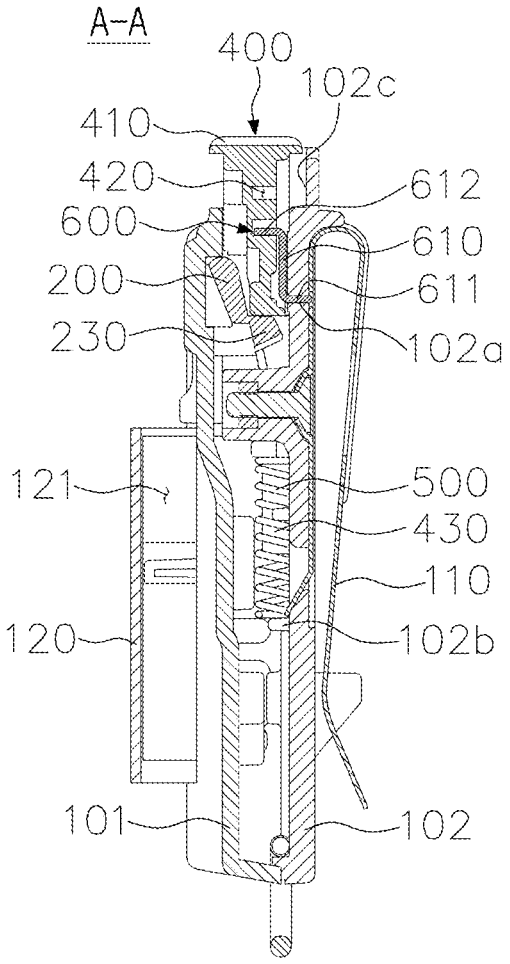
FIG. 16 is a cross-sectional view taken along line A-A of FIG. 14.

A clip holding part 120 is coupled to the front of the holder body 100, and a clip through hole 121 is formed in the vertical direction between the holder body 100 and the clip holding part 120 (see FIGS. 1 and 16)

The clip holding part 120 is manufactured separately from the holder body 100 and is bolted to the holder body 100.

When the belt clip of the tape measure is inserted vertically downward from the top of the clip through hole 121, the tape measure is mounted on the holder body 100.

A pair of elastic fixing pieces 130 in the form of leaf springs are provided on the front of the holder body 100.

Figure 14:
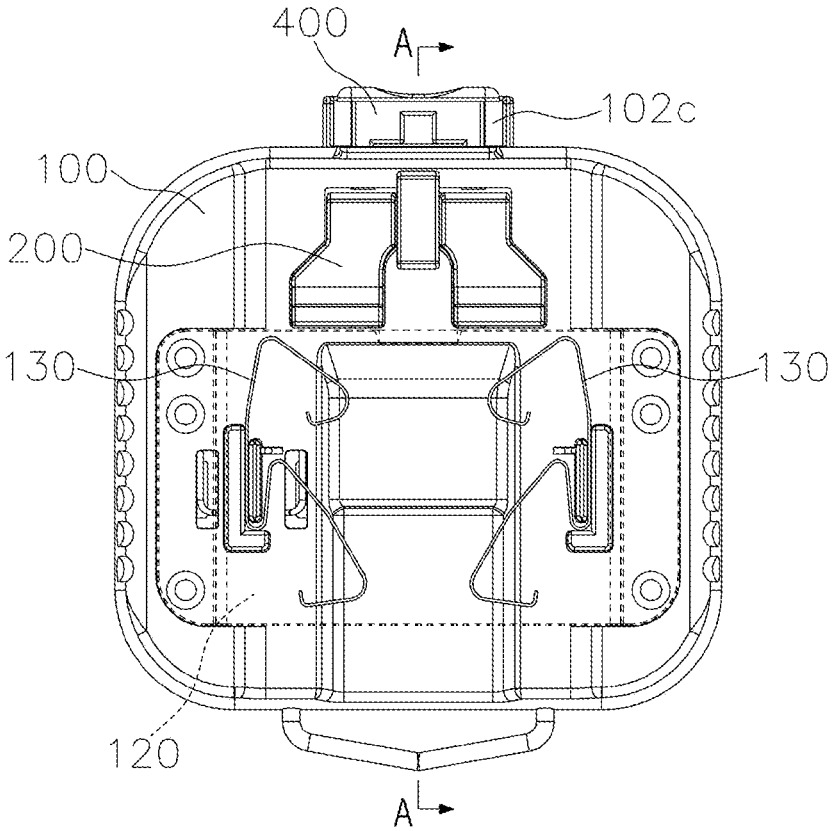
FIG. 14 is a front view of FIG. 1 showing a clip holding part with a hidden line.

The pair of elastic fixing pieces 130 are located inside the clip through hole 121 and are used to hold and secure the belt clip inserted into the clip through hole 121 on both sides of the belt clip in the left and right directions (see FIG. 14)

For the description of the belt coupling portion 110, the clip holding part 120, the elastic fixing pieces 130, etc. described above, reference is made to U.S. Pat. No. 11,517,103, which is incorporated herein, and detailed description is omitted.

Figure 4:
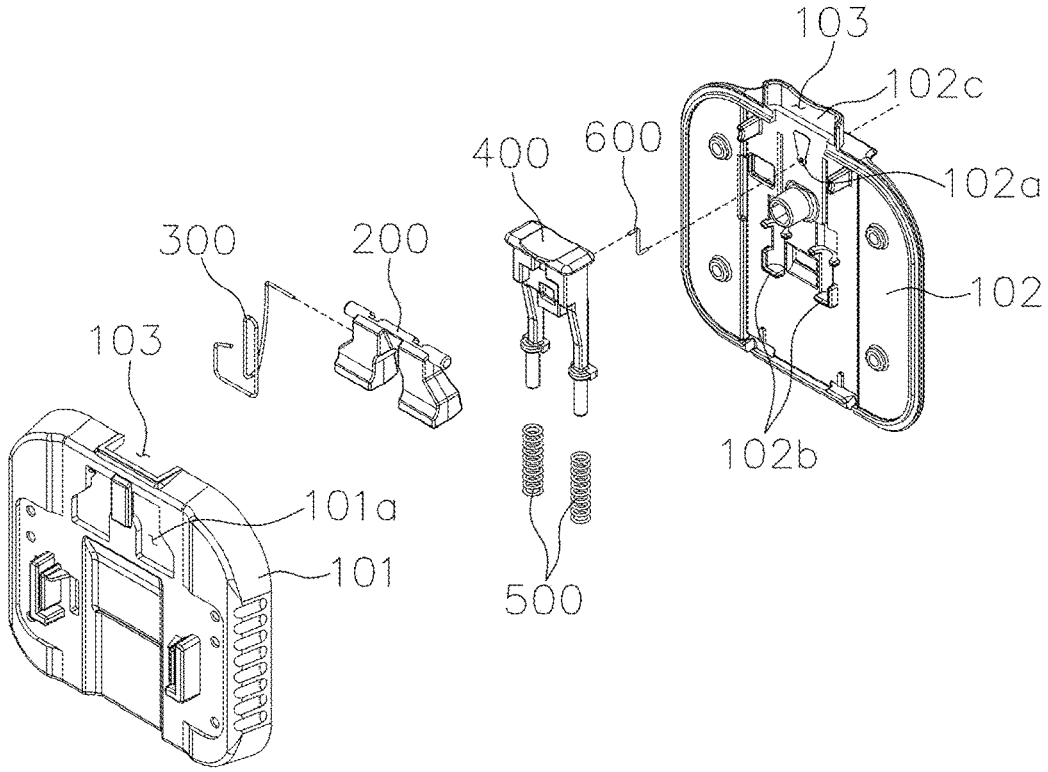
FIG. 4 is an exploded perspective view showing the main parts in FIG. 3 separated.
Figure 5:
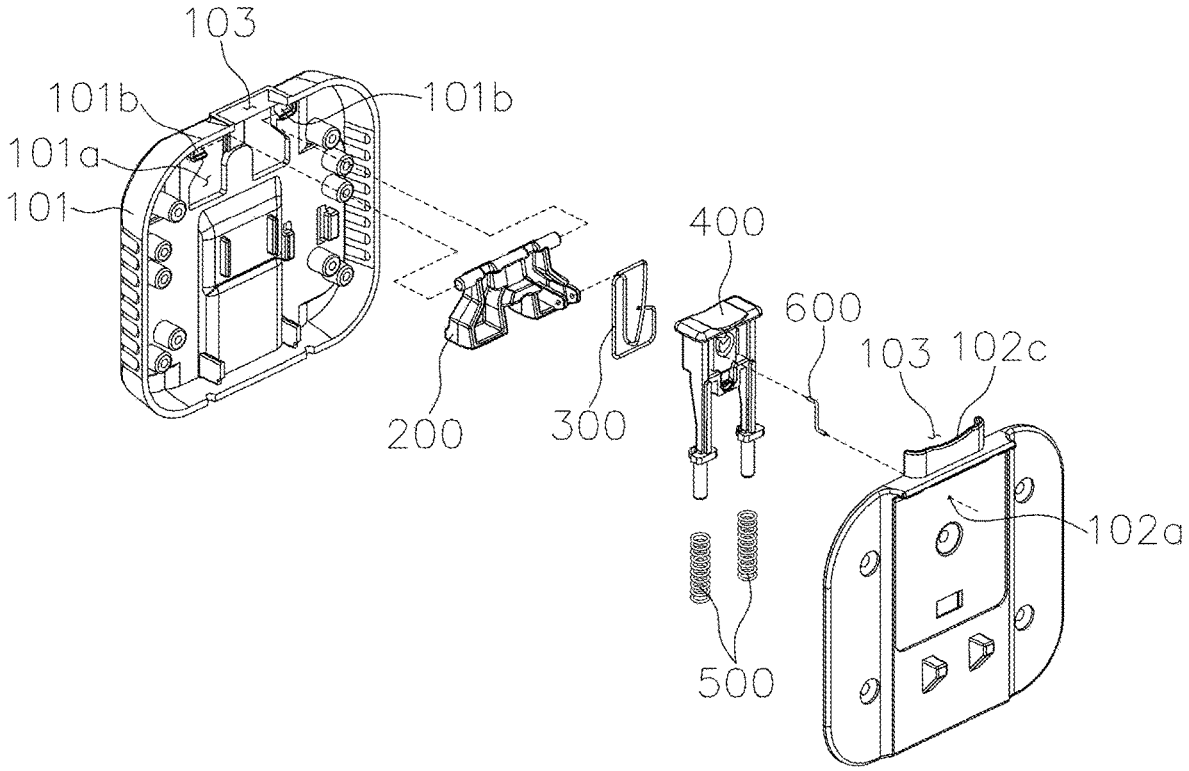
FIG. 5 is a perspective view of FIG. 4 viewed from the rear.
Figure 6:
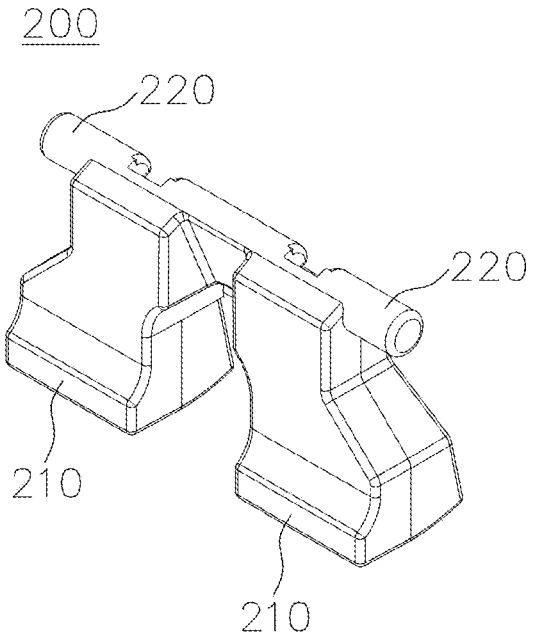
FIGS. 6 and 7 are perspective views of a locking bracket shown in FIG. 4.
Figure 7:
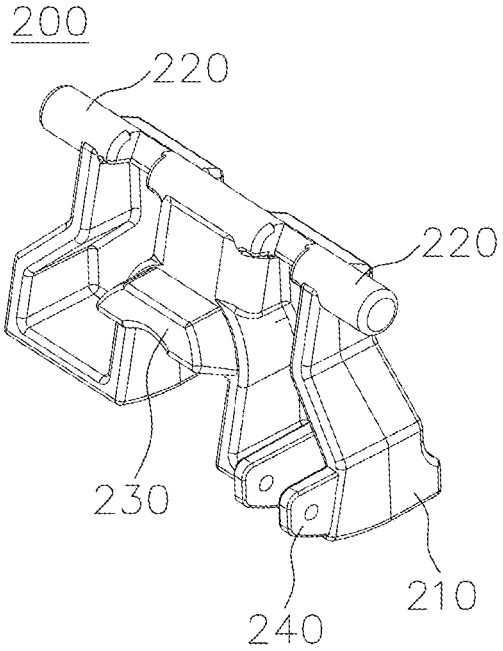
Figure 8:
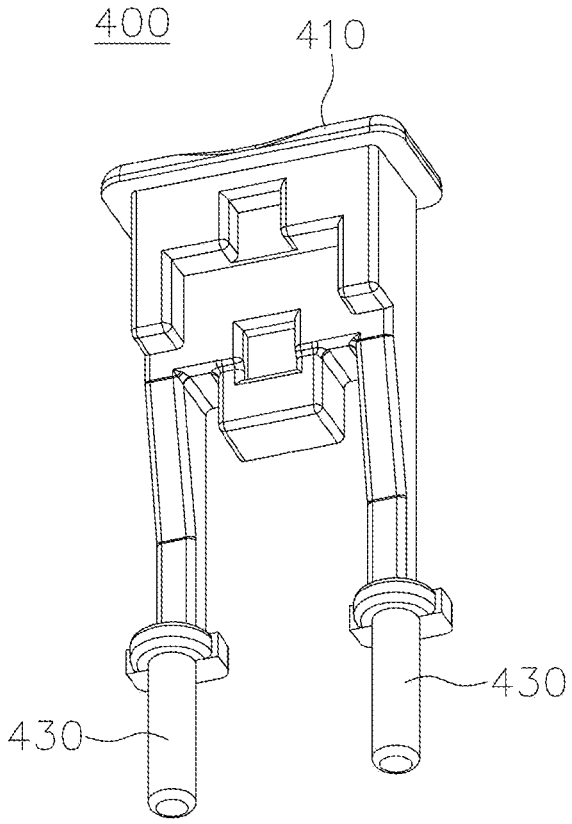
FIGS. 8 and 9 are perspective views of a push button shown in FIG. 4.

The holder body 100 has a structure in which a front body 101 and a rear body 102 are assembled together to form an empty space inside the holder body 100 (see FIGS. 4 and 5).

The locking bracket 200 is coupled to the front body 101, and a pair of openings 101*a* are formed in the front body 101 for the locking bracket 200 to pass through.

At the rear of the front body 101, a shaft coupling portion 101*b* is formed to engage a rotation shaft 220 of the locking bracket 200, which will be described later.

The rear body 102 is provided with a pin coupling hole 102*a* through which a first coupling end 611 of the position maintenance pin 600, which will be described later, is coupled.

A spring support jaw 102*b* is formed on the front of the rear body 102 to support the lower end of the push button spring 500.

On the upper part of the rear body 102, a push button protection wall 102*c* is provided to protrude upward to prevent the push button 400, which will be described later, from being pressed unintentionally.

A push button opening 103 is formed on the upper surface of the holder body 100 to guide the vertical movement of the push button 400.

The push button opening 103 is formed by combining the front body 101 and the rear body 102, and is located in front of the push button protection wall 102*c*.

The locking bracket 200 includes a locking jaw 210, the rotation shaft 220, a rotational force input portion 230, and a first spring coupling portion 240.

The locking jaw 210 is provided on the lower side of the locking bracket 200 to prevent the belt clip of the tape measure from leaving the clip through hole 121. In this embodiment, two locking jaws 210 are provided.

The rotation shaft 220 is provided on the upper side of the locking bracket 200 and is rotatably coupled to the shaft coupling portion 101*b* of the holder body 100.

The rotational force input portion 230 is a part provided inside the locking bracket 200 and is a part that receives a rotational force from the push button 400, which will be described later.

The first spring coupling portion 240 is a part where the bracket spring 300, which will be described later, is coupled.

When the push button 400 inputs a rotational force to the rotational force input portion 230 of the locking bracket 200, the locking jaw 210 may be rotated around the rotation shaft 220 to move to a position that prevents the belt clip from coming off.

The bracket spring 300 has one end coupled to the holder body 100 and the other end coupled to the first spring coupling portion 240 of the locking bracket 200 to elastically support the locking bracket 200 in one direction so that the locking jaw 210 of the locking bracket 200 is located in a position that does not prevent the belt clip from coming off.

Thus, when there is no external force, the locking jaw 210 of the locking bracket 200 is located in a position that does not prevent the belt clip from coming off due to the bracket spring 300, whereas when the push button 400 inputs a rotational force to the rotational force input portion 230 of the locking bracket 200, the locking jaw 210 moves to a position that prevents the belt clip from coming off.

As described above, the locking jaw 210 of the locking bracket 200 may be switched between the locked state and the unlocked state. In this case, the locked state is a state in which the locking jaw 210 of the locking bracket 200 has moved to a position that prevents the belt clip from coming off, and in this state, the belt clip cannot separate the tape measure inserted into the clip through hole 121 from the belt holder.

On the other hand, the unlocked state is a state in which the locking jaw 210 of the locking bracket 200 has moved to a position that does not prevent the belt clip from coming off, and in this state, the belt clip of the tape measure may be inserted into the clip through hole 121 to mount the tape measure to the belt holder, or the belt clip of the tape measure inserted into the clip through hole 121 may be separated from the belt holder.

FIGS. 1 to 5, FIG. 14, and FIGS. 16 to 18 are shown based on the unlocked state.

FIGS. 15, 19 to 21 are shown based on the locked state.

The push button 400 is provided to apply or not apply a rotational force to the locking bracket 200.

The push button 400 is guided to reciprocate in the vertical direction by the holder body 100 and is arranged to penetrate the push button opening 103 of the holder body 100.

By moving downward, the push button 400 applies a rotational force to the rotational force input portion 230 of the locking bracket 200, and by moving upward, the push button 400 no longer applies a rotational force to the rotational force input portion 230 of the locking bracket 200.

The push button 400 has a push input portion 410 provided at the top, a one-way rotation inducing groove 420 is formed at the center in the vertical direction, and a second spring coupling portion 430 is formed at the bottom.

The push input portion 410 is a part that receives a user's push operation. That is, a user's pressing force is input to the push input portion 410.

The one-way rotation inducing groove 420 is a closed curve-shaped groove, and is a part into which a second coupling end 612 of the position maintenance pin 600, which will be described later, is inserted so as to guide the second coupling end 612 of the position maintenance pin 600 to rotate in one direction according to the up and down movement of the push button 400. The one-way rotation inducing groove 420 will be described later.

The second spring coupling portion 430 is a part where the push button spring 500, which will be described later, is coupled.

The lower end of the push button spring 500 is supported by the spring support jaw 102*b* of the holder body 100 to elastically support the push button 400 in an upward direction.

The position maintenance pin 600 includes: an up/down extension portion 610 extending in the vertical direction; a first coupling end 611 bent in the horizontal direction at the bottom of the up/down extension portion 610 and inserted into and coupled to the pin coupling hole 102*a* of the holder body 100; and a second coupling end 612 bent in the horizontal direction at the top of the up/down extension portion 610 and inserted into the one-way rotation inducing groove 420 of the push button 400.

Figure 9:
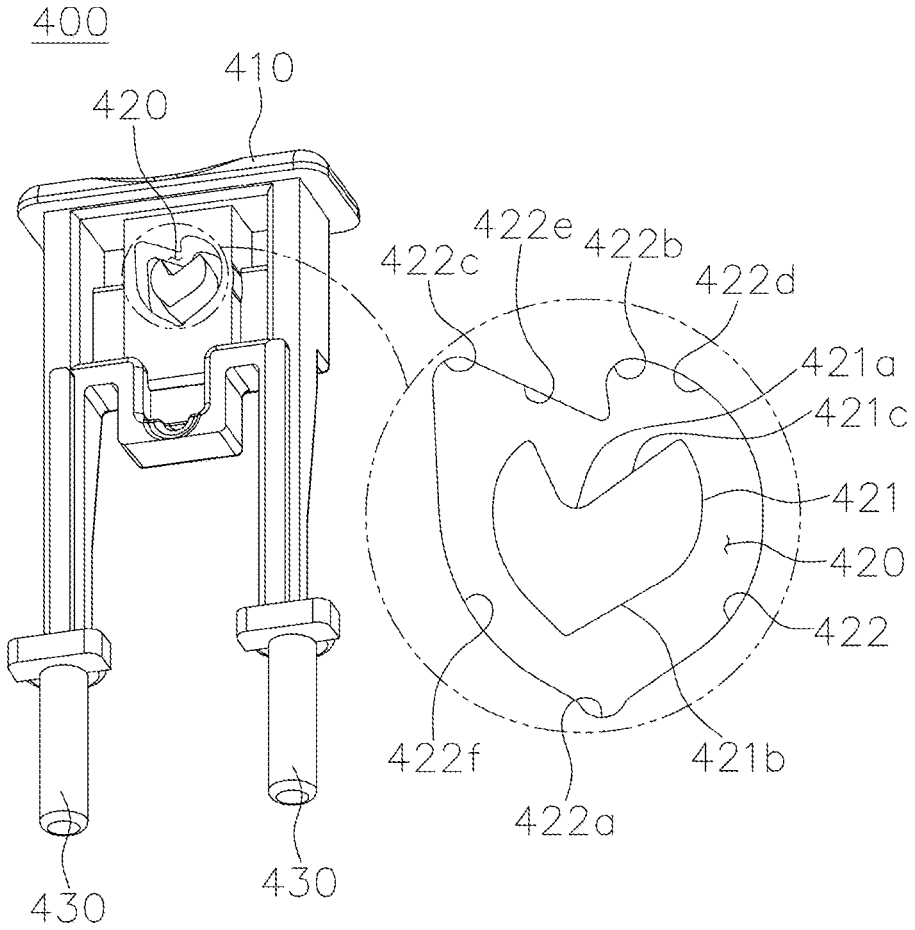
Figure 10:
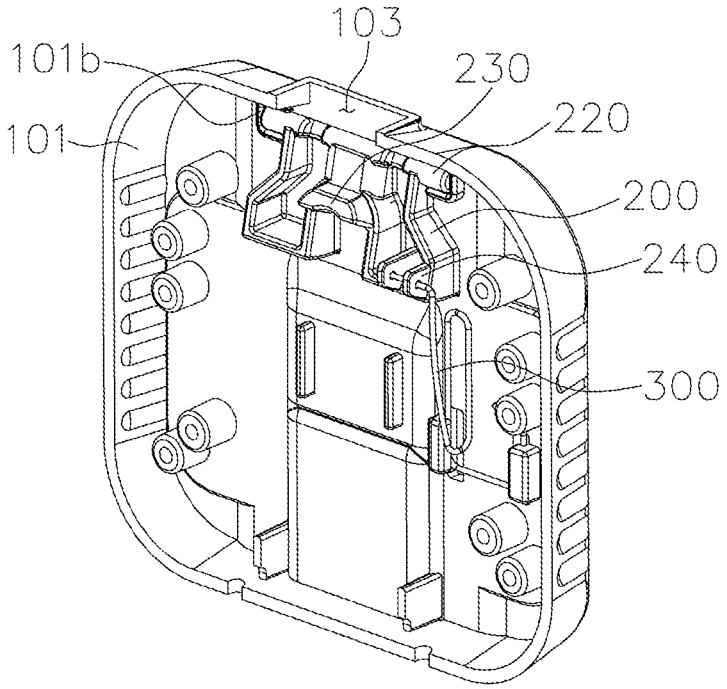
FIG. 10 is a perspective view of the locking bracket and a locking bracket spring coupled to a front body.
Figure 11:
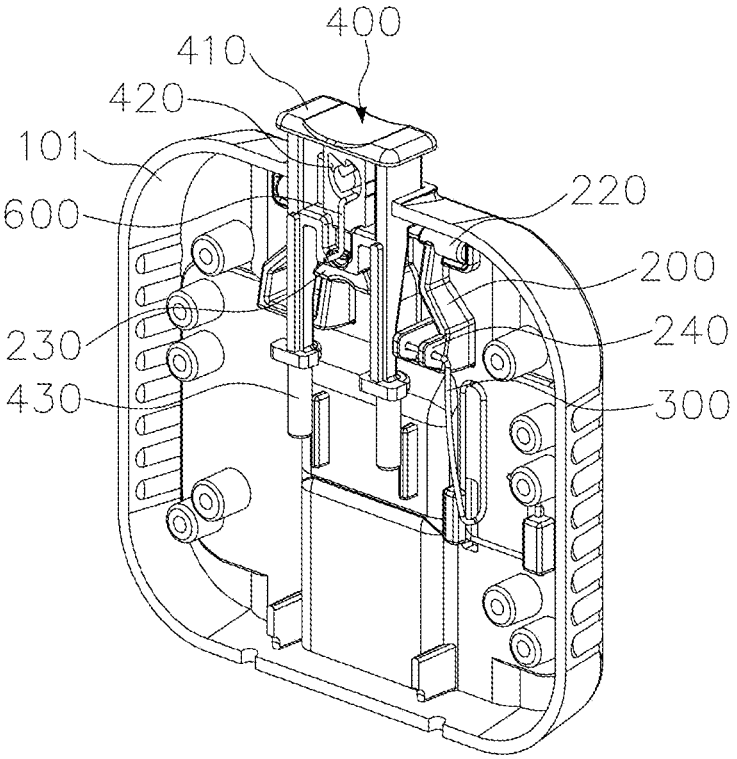
FIG. 11 is a perspective view of FIG. 10 with the push button and a position maintenance pin additionally combined.
Figure 12:
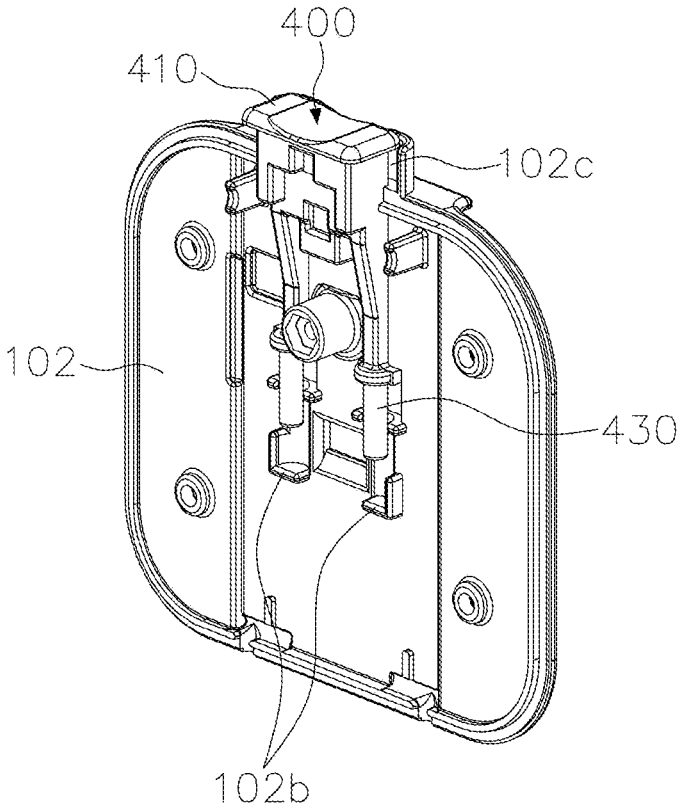
FIG. 12 is a perspective view of the push button coupled to a rear body.
Figure 13:
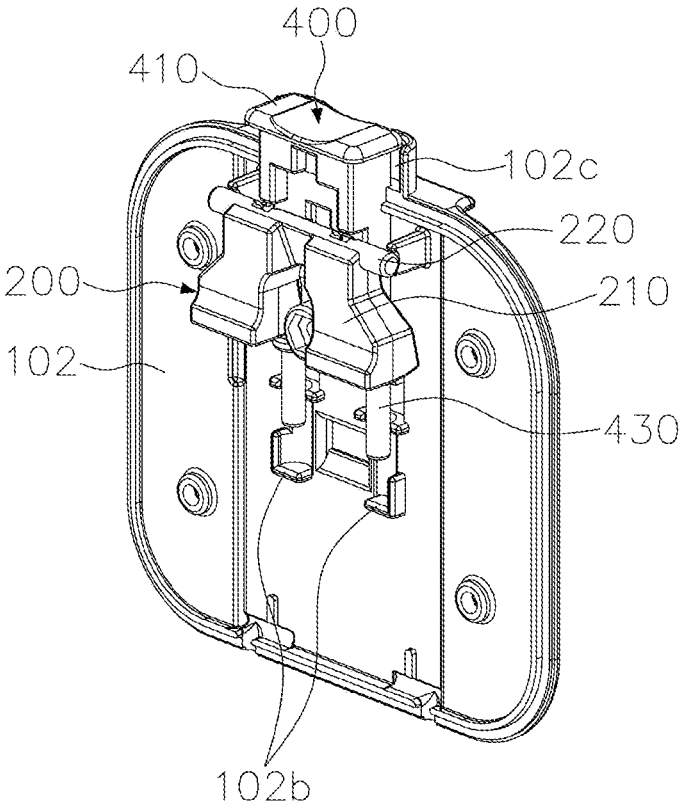
FIG. 13 is a perspective view of FIG. 12 with the locking bracket is additionally combined.

Referring to FIG. 9, the one-way rotation inducing groove 420 will be described in detail.

The one-way rotation inducing groove 420 is formed between an inner guide wall 421 and an outer guide wall 422 that face each other and are spaced apart.

Both the inner guide wall 421 and the outer guide wall 422 extend in the form of a closed curve, and the outer guide wall 422 is arranged to surround the inner guide wall 421.

The inner guide wall 421 includes a second seating portion 421*a*, a first inner guide surface 421*b*, and a second inner guide surface 421*c*.

The outer guide wall 422 includes a first seating portion 422*a*, a first movement restriction portion 422*b*, a second movement restriction portion 422*c*, a first outer guide surface 422*d*, a second outer guide surface 422*e*, and a third outer guide surface 422*f*.

The second coupling end 612 of the position maintenance pin 600 may be seated on the first seating portion 422*a* or the second seating portion 421*a*.

At this time, the second seating portion 421*a* is formed at a higher position than the first seating portion 422*a*.

That is, due to the up and down movement of the push button 400, the second coupling end 612 of the position maintenance pin 600 rotates in one direction along the one-way rotation inducing groove 420 and may be seated on the first seating portion 422*a* or the second seating portion 421*a*.

The state in which the second coupling end 612 of the position maintenance pin 600 is seated on the first seating portion 422*a* and the state in which the second coupling end 612 of the position maintenance pin 600 is seated on the second seating portion 421*a* will be described, respectively.

When the second coupling end 612 of the position maintenance pin 600 is seated on the first seating portion 422*a* of the outer guide wall 422, the upper end of the push button 400 is maintained at an upper position La, and in this case, the locking jaw 210 of the locking bracket 200 is positioned in a position that does not prevent the belt clip from coming off and is in an unlocked state.

Figure 17:
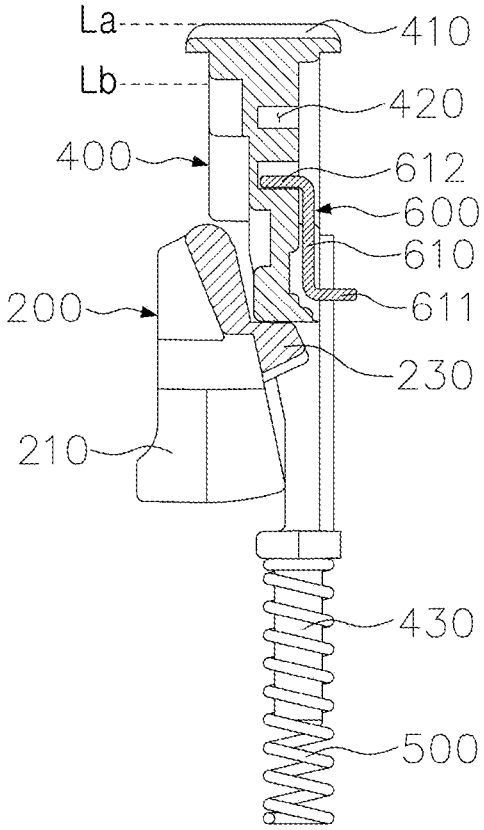
FIG. 17 is a cross-sectional view showing the relationship between the push button, the locking bracket, and the position maintenance pin in FIG. 16.
Figure 18:
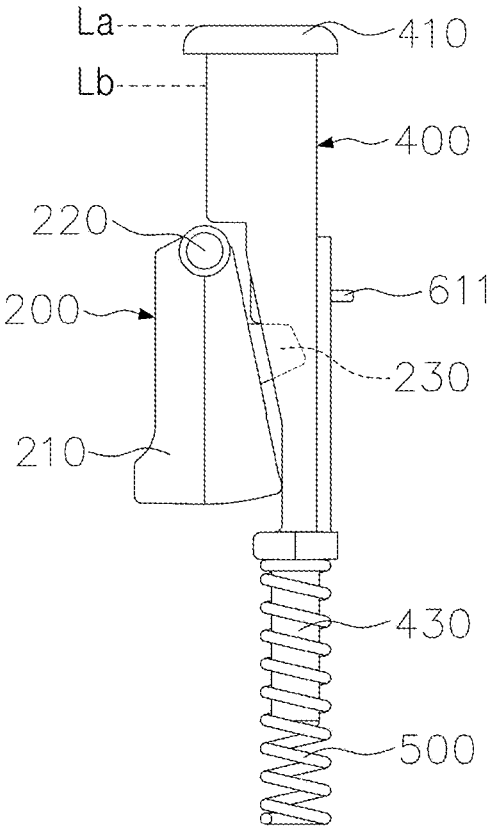
FIG. 18 is a side view of FIG. 17.

As shown in FIGS. 16 to 18, the push button 400 moves upward and does not input rotational force to the rotational force input portion 230 of the locking bracket 200, and due to the bracket spring 300, the locking jaw 210 of the locking bracket 200 is positioned at a position that does not prevent the belt clip from coming off.

Thus, the locking bracket 200 is in the same state as in FIG. 1.

On the other hand, when the second coupling end 612 of the position maintenance pin 600 is seated on the second seating portion 421*a* of the inner guide wall 421, the upper end of the push button 400 is maintained at a lower position Lb, and in this case, the locking jaw 210 of the locking bracket 200 is positioned in a position that prevents the belt clip from coming off and is in a locked state.

Figure 19:
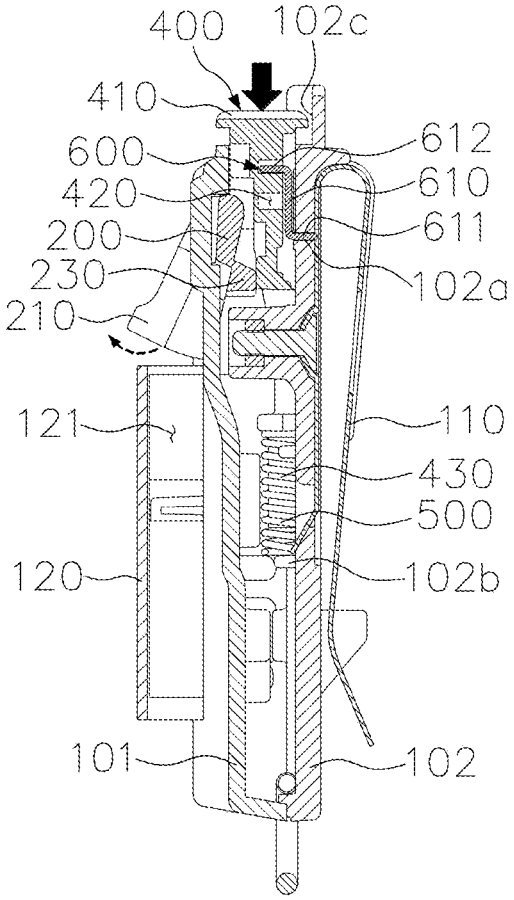
FIG. 19 is a view corresponding to FIG. 16 when the belt holder for a tape measure is switched to the locked state.
Figure 20:
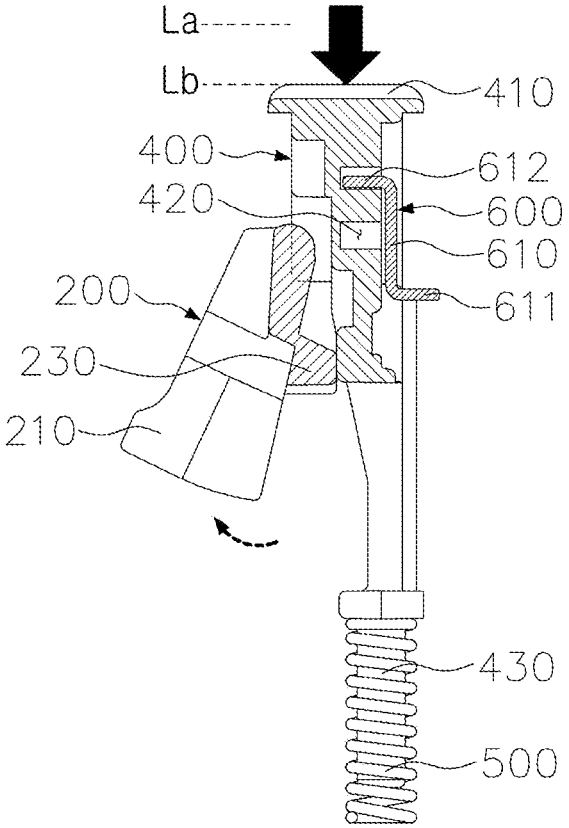
FIG. 20 is a cross-sectional view showing the relationship between the push button, the locking bracket, and the position maintenance pin in FIG. 19.
Figure 21:
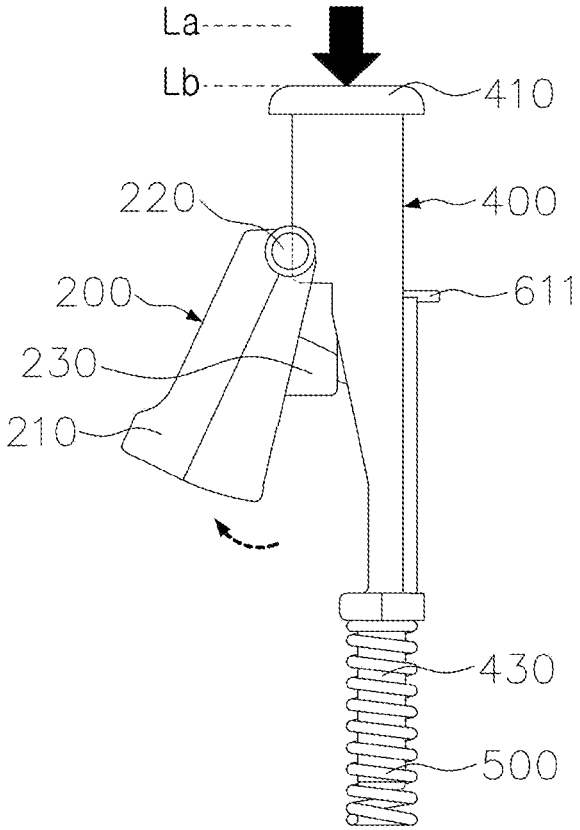
FIG. 21 is a side view of FIG. 20.
Figure 22:
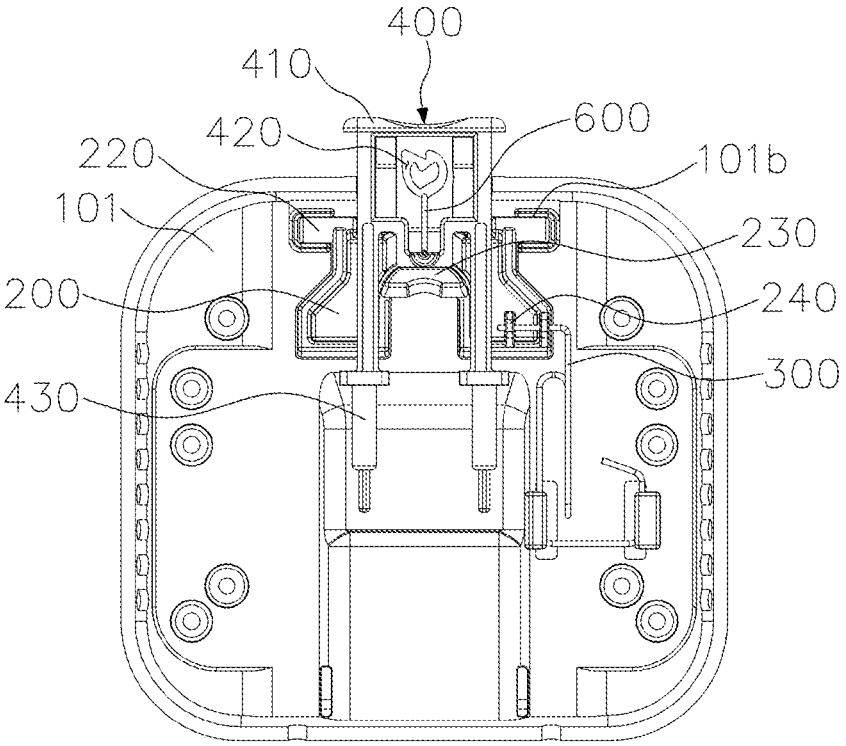
FIG. 22 is a rear view of the front body with the locking bracket, the locking bracket spring, the push button, and the position maintenance pin combined.

As shown in FIGS. 19 to 21, the push button 400 moves downward and inputs a rotational force to the rotational force input portion 230 of the locking bracket 200, whereby the locking jaw 210 of the locking bracket 200 is positioned at a position that prevents the belt clip from coming off.

Figure 15:
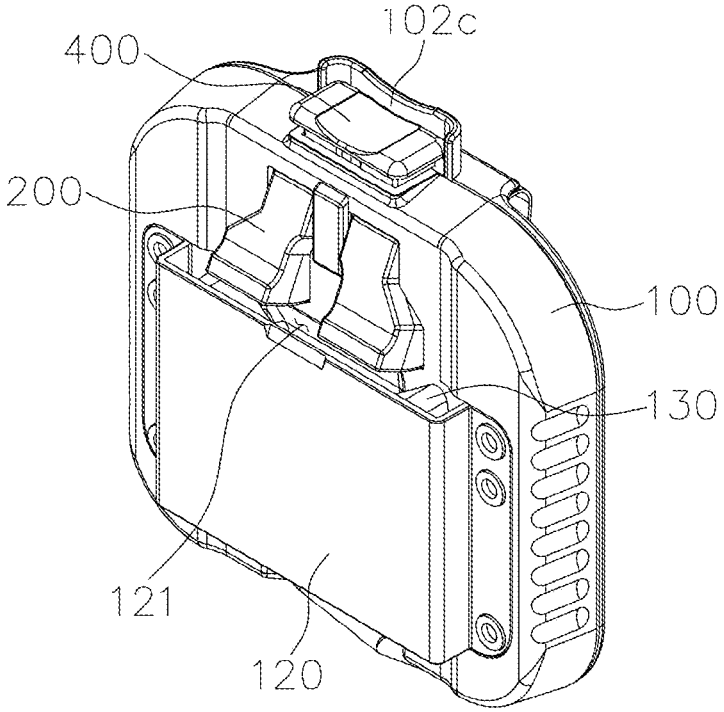
FIG. 15 is a perspective view of the belt holder for a tape measure of FIG. 1 in a locked state.

Thus, the locking bracket 200 is in the same state as in FIG. 15.

Next, the one-way rotation inducing action of the one-way rotation inducing groove 420 will be explained.

The first movement restriction portion 422*b* and the second movement restriction portion 422*c* are respectively formed on opposite sides of the outer guide wall 422 in the width direction.

The first movement restriction portion 422*b* is formed on one side in the width direction at a higher position than the second seating portion 421*a* to limit the upward movement range of the second coupling end 612.

The second movement restriction portion 422*c* is formed on the other side in the width direction at a higher position than the second seating portion 421*a* to limit the upward movement range of the second coupling end 612.

In this structure, the push button 400 moves downward by the user's operation, and when there is no external force, the push button 400 moves upward by the elastic force of the push button spring 500.

Figure 23:
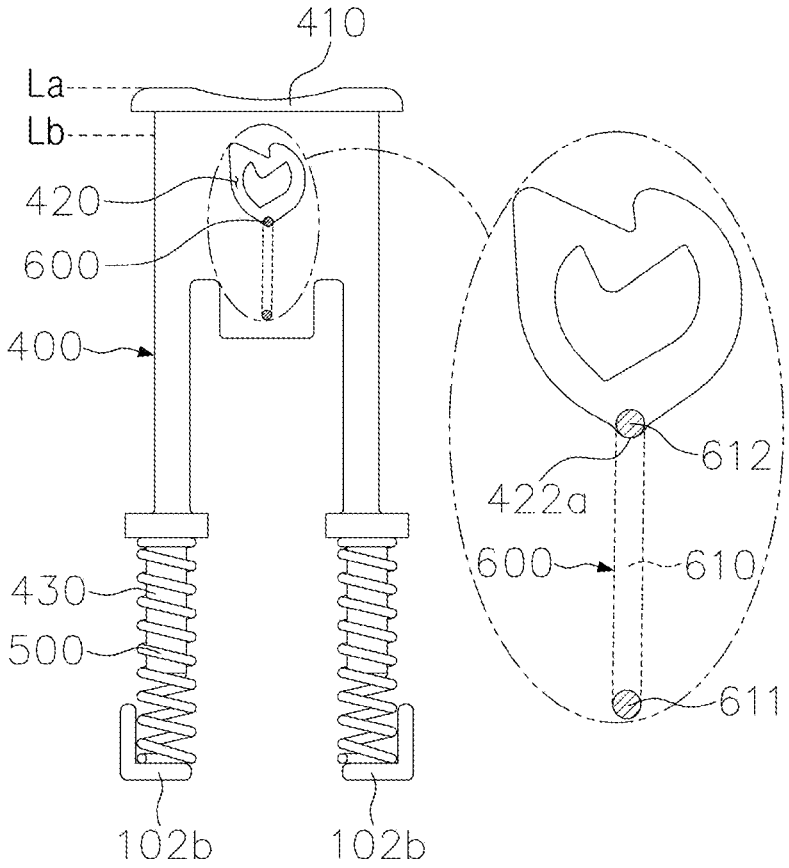
FIGS. 23 to 27 are conceptual views showing a state in which a second coupling end of the position maintenance pin is located in a one-way rotation inducing groove as the push button is pushed in and out.
Figure 24:
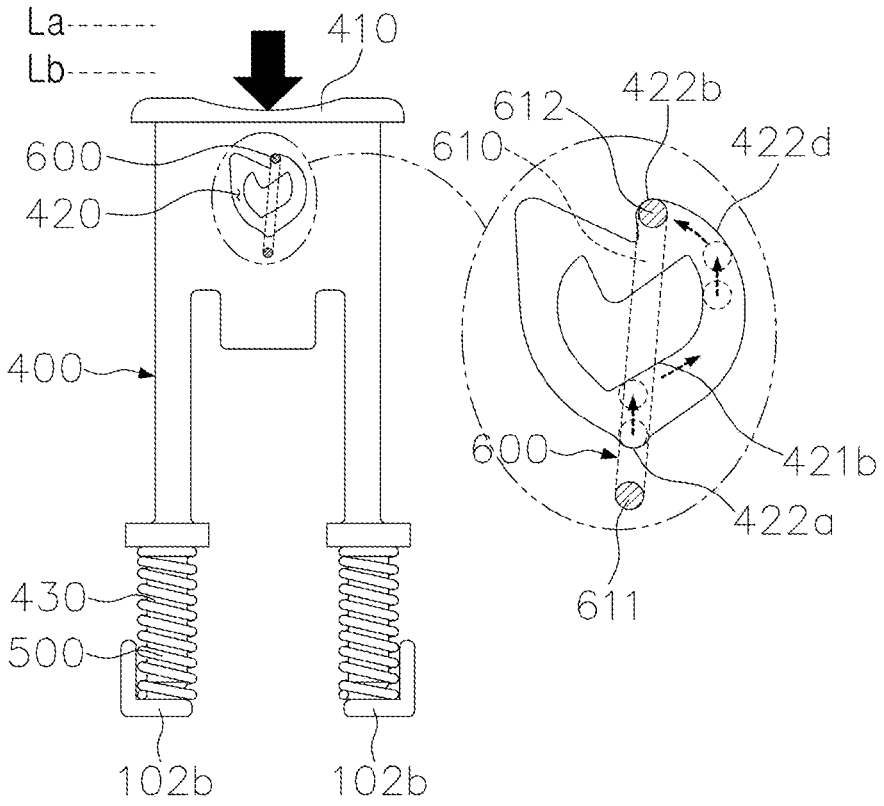

As shown in FIG. 23, in a state where the push button 400 is located at the upper position La and the second coupling end 612 is seated on the first seating portion 422*a*, when the push button 400 moves downward by the user's operation, the second coupling end 612 moves from the first seating portion 422*a* to the first movement restriction portion 422*b*, as shown in FIG. 24.

At this time, in the process of converting from FIG. 23 to FIG. 24, the first inner guide surface 421*b* and the first outer guide surface 422*d* are used.

The first inner guide surface 421*b* guides the second coupling end 612 in one width direction when the second coupling end 612 located in the first seating portion 422*a* moves to the first movement restriction portion 422*b*. That is, the first inner guide surface 421*b* is shaped to extend to one side in the width direction while pointing upward.

The first outer guide surface 422*d* guides the second coupling end 612 in the other width direction when the second coupling end 612 past the first inner guide surface 421*b* moves to the first movement restriction portion 422*b*, and the first outer guide surface 422*d* has the first movement restriction portion 422*b* connected to the upper part thereof. That is, the first outer guide surface 422*d* is shaped to extend inward in the width direction while pointing upward.

Figure 25:
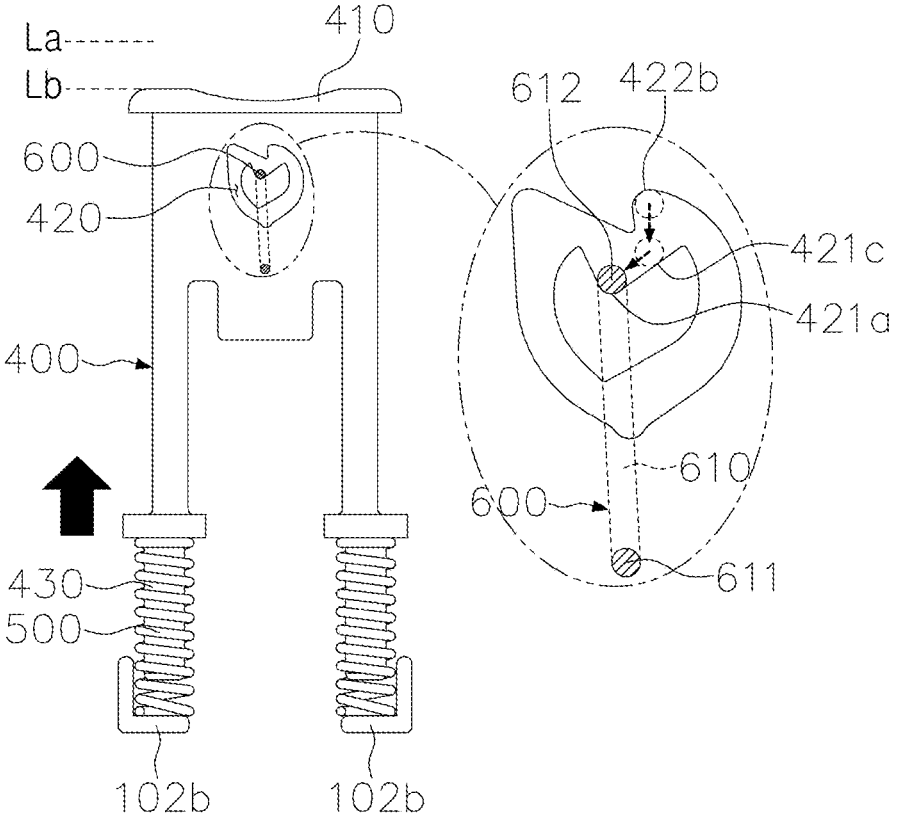

In the above state, when the force applied to the push button 400 is removed, the push button 400 moves upward due to the elastic force of the push button spring 500, and as shown in FIG. 25, the second coupling end 612 moves from the first movement restriction portion 422*b* to the second seating portion 421*a*.

At this time, in the process of converting from FIG. 24 to FIG. 25, the second inner guide surface 421*c* is used.

The second inner guide surface 421*c* guides the second coupling end 612 in the other width direction when the second coupling end 612 located in the first movement restriction portion 422*b* moves to the second seating portion 421*a*, and has the second seating portion 421*a* connected to the lower part thereof. That is, the second inner guide surface 421*c* is shaped to extend to the other side in the width direction while pointing downward.

As a result, the push button 400 is located at the lower position Lb and the second coupling end 612 is seated on the second seating portion 421*a*.

Figure 26:
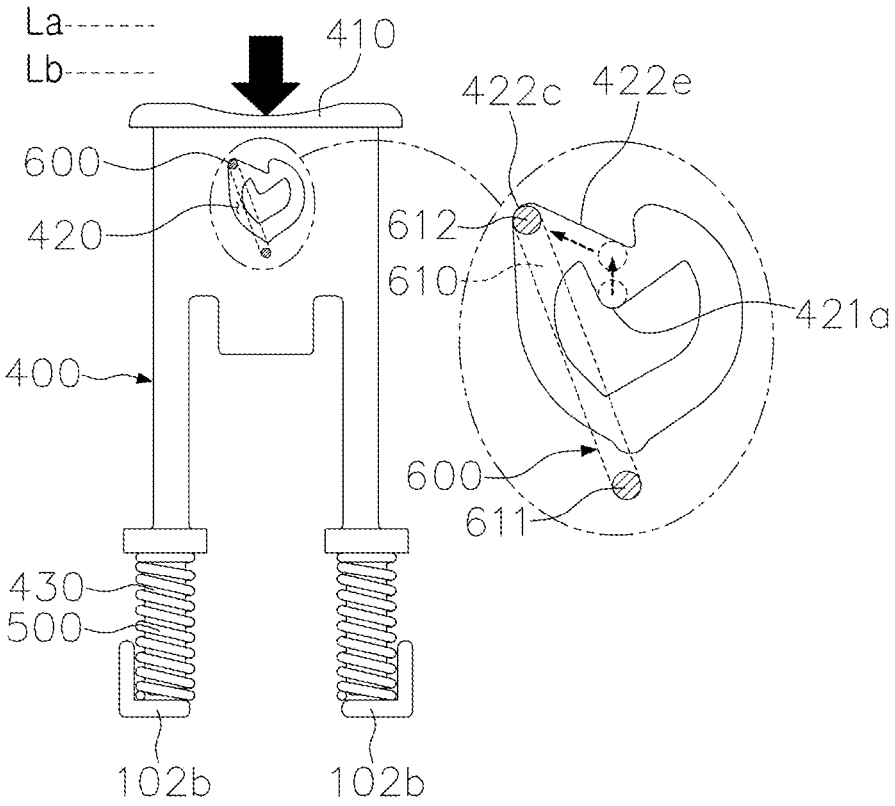

In a state where the push button 400 is located at the lower position Lb and the second coupling end 612 is seated on the second seating portion 421*a*, when the push button 400 moves downward by the user's operation, the second coupling end 612 moves from the second seating portion 421*a* to the second movement restriction portion 422*c*, as shown in FIG. 26.

At this time, in the process of converting from FIG. 25 to FIG. 26, the second outer guide surface 422*e* is used.

The second outer guide surface 422*e* guides the second coupling end 612 in the other width direction when the second coupling end 612 located in the second seating portion 421*a* moves to the second movement restriction portion 422*c*, and has the second movement restriction portion 422*c* connected to the upper part thereof. That is, the second outer guide surface 422*e* is shaped to extend to the other side in the width direction while pointing upward.

Figure 27:
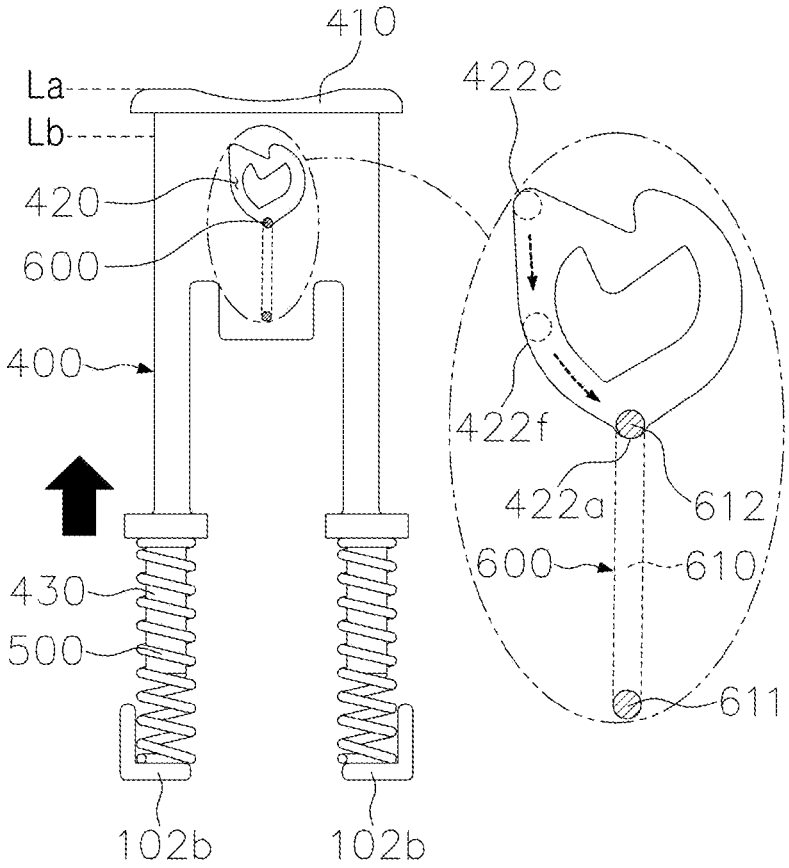

In the above state, when the force applied to the push button 400 is removed, the push button 400 moves upward due to the elastic force of the push button spring 500, and as shown in FIG. 27, the second coupling end 612 moves from the second movement restriction portion 422*c* to the first seating portion 422*a*.

At this time, in the process of converting from FIG. 26 to FIG. 27, the third outer guide surface 422*f* is used.

The third outer guide surface 422*f* guides the second coupling end 612 in one width direction when the second coupling end 612 located in the second movement restriction portion 422*c* moves to the first seating portion 422*a*, and has the first seating portion 422*a* connected to the lower part thereof. That is, the third outer guide surface 422*f* is shaped to extend to one side in the width direction while pointing downward.

As a result, the push button 400 is again located at the upper position La and the second coupling end 612 is seated on the first seating portion 422*a*.

By repeating the operation of the push button 400 as described above, the locking jaw 210 of the locking bracket 200 is alternately located at a position where it does not prevent the belt clip from coming off and at a position where it prevents the belt clip from coming off.

The foregoing description of the present disclosure is for illustrative purposes only, and those skilled in the art to which the present disclosure pertains will understand that the present disclosure may be easily modified into another specific form without changing its technical idea or essential features. Therefore, the embodiments described above should be understood in all respects as illustrative and not restrictive. For example, any component described as a single component may be implemented in a divided form, and similarly, components described as separate may be implemented in a combined form.

The scope of the present disclosure is indicated by the claims described below rather than the detailed description above, and the meaning and scope of the patent claims and all changes or modified forms derived from the equivalent concept thereof should be construed as being included in the scope of the present disclosure.

What is claimed is:

1. A belt holder for a tape measure, the belt holder comprising:

a holder body, with a clip holding part being attached to a front thereof so that a clip through hole is formed between the holder body and the clip holding part in a vertical direction through which a belt clip of the tape measure passes;

a locking bracket comprising: a locking jaw provided on a lower side thereof to prevent the belt clip of the tape measure from escaping from the clip through hole; a rotation shaft provided on an upper side thereof to be rotatably coupled to the holder body; and a rotational force input portion provided on an inside thereof, wherein when a rotational force is input to the rotational force input portion, the locking jaw may be rotated around the rotation shaft to move from a position that does not prevent the belt clip from coming off to a position that prevents the belt clip from coming off;

a bracket spring provided in the holder body to elastically support the locking bracket in one direction so that the locking jaw of the locking bracket is located at a position that does not prevent the belt clip from coming off;

a push button having a push input portion at a top thereof and a one-way rotation inducing groove in the form of a closed curve provided at a center thereof in the vertical direction, and guided by the holder body to reciprocate in the vertical direction so as to apply a rotational force to the rotational force input portion of the locking bracket by moving downward and so as to not apply a rotational force to the rotational force input portion of the locking bracket by moving upward;

a push button spring provided in the holder body to elastically support the push button in an upward direction; and a position maintenance pin comprising: an up/down extension portion extending in the vertical direction; a first coupling end bent in a horizontal direction at a bottom of the up/down extension portion and inserted into and coupled to a pin coupling hole of the holder body; and a second coupling end bent in the horizontal direction at a top of the up/down extension portion and inserted into the one-way rotation inducing groove of the push button, wherein the one-way rotation inducing groove comprises: a first seating portion capable of seating the second coupling end; and a second seating portion provided at a higher position than the first seating portion and capable of seating the second coupling end, and according to up and down movements of the push button, the second coupling end of the position maintenance pin may be seated on the first seating portion or the second seating portion while rotating in one direction along the one-way rotation inducing groove.

2. The belt holder of claim 1, wherein the one-way rotation inducing groove further comprises: a first movement restriction portion provided on a first side in a width direction at a position higher than the second seating portion to limit an upper movement range of the second coupling end; and a second movement restriction portion provided on a second side in the width direction at a position higher than the second seating portion to limit the upper movement range of the second coupling end, wherein due to a downward movement of the push button, the second coupling end located at the first seating portion moves to the first movement restriction portion, due to an upward movement of the push button, the second coupling end located at the first movement restriction portion moves to the second seating portion, due to the downward movement of the push button, the second coupling end located at the second seating portion moves to the second movement restriction portion, due to the upward movement of the push button, the second coupling end located at the second movement restriction portion moves to the first seating portion, so that the second coupling end may rotate in one direction along the one-way rotation inducing groove.

3. The belt holder of claim 2, wherein the one-way rotation inducing groove is formed between an inner guide wall extending in the form of a closed curve and an outer guide wall that extends in the form of a closed curve and is arranged to surround the inner guide wall, wherein the inner guide wall comprises:

a first inner guide surface that guides the second coupling end in a first width direction when the second coupling end located in the first seating portion moves to the first movement restriction portion; and a second inner guide surface that guides the second coupling end in a second width direction when second coupling end located in the first movement restriction portion moves to the second seating portion, and has the second seating portion connected to a lower part thereof, and the outer guide wall comprises:

a first outer guide surface that guides the second coupling end in the second width direction when the second coupling end past the first inner guide surface moves to the first movement restriction portion;

a second outer guide surface that guides the second coupling end in the second width direction when the second coupling end when the second coupling end located in the second seating portion moves to the second movement restriction portion, and has the second movement restriction portion connected to an upper part thereof; and a third outer guide surface that guides the second coupling end in the first width direction when the second coupling end located in the second movement restriction portion moves to the first seating portion, and has the first seating portion connected to a lower part thereof.

* * * * *